US008939319B2

(12) United States Patent
Koch et al.

(10) Patent No.: US 8,939,319 B2
(45) Date of Patent: Jan. 27, 2015

(54) THERMOTHERAPHY DEVICE

(75) Inventors: Jochim Koch, Ratzeburg (DE); Philip Möhring, Lübeck (DE); Harald Kneuer, Ambler, PA (US)

(73) Assignee: Dräger Medical GmbH, Lübeck (DE)

( * ) Notice: Subject to any disclaimer, the term of this patent is extended or adjusted under 35 U.S.C. 154(b) by 31 days.

(21) Appl. No.: 13/337,623

(22) Filed: Dec. 27, 2011

(65) Prior Publication Data

US 2012/0191165 A1 Jul. 26, 2012

(30) Foreign Application Priority Data

Jan. 20, 2011 (DE) ..... 10 2011 009 032

(51) Int. Cl.
*B65D 43/14* (2006.01)
*B65D 51/04* (2006.01)
*A61G 11/00* (2006.01)

(52) U.S. Cl.
CPC ..... *A61G 11/006* (2013.01); *A61G 11/008* (2013.01); *A61G 11/003* (2013.01); *A61G 11/002* (2013.01)
USPC ..... 220/815; 220/830; 220/348; 600/22

(58) Field of Classification Search
USPC ..... 220/815, 811, 812, 813, 830, 348, 211, 220/351, 345.1; 600/22
See application file for complete search history.

(56) References Cited

U.S. PATENT DOCUMENTS 2,600,240 A * 6/1952 Grieb ..... 600/22
2,791,348 A * 5/1957 Adams ..... 220/812
3,529,590 A * 9/1970 Grosholz ..... 600/22
4,320,852 A * 3/1982 Nagelkirk ..... 220/812
4,334,629 A 6/1982 Koch et al.
4,821,902 A * 4/1989 May ..... 220/812
5,308,310 A 5/1994 Roff et al.
5,404,840 A * 4/1995 Wiedenmann et al. ..... 119/266
5,971,914 A 10/1999 Donnelly et al.
6,231,499 B1 5/2001 Jones
6,669,023 B2 * 12/2003 Kikuchi et al. ..... 206/759
7,591,395 B2 * 9/2009 Hamaguchi ..... 220/830
2001/0049465 A1 * 12/2001 Goldberg et al. ..... 600/22
2010/0222638 A1 * 9/2010 Chilton, III ..... 600/22
2010/0286471 A1 * 11/2010 Matsubara et al. ..... 600/22

FOREIGN PATENT DOCUMENTS

DE 60 2004 006 684 T2 1/2008
WO 2009073693 A1 6/2009

* cited by examiner

*Primary Examiner* — Mickey Yu
*Assistant Examiner* — Niki Eloshway
(74) *Attorney, Agent, or Firm* — McGlew and Tuttle, P.C.

(57) ABSTRACT

A thermotherapy device (1) includes a basic housing (2) with walls (14) with a support for a patient and an especially transparent covering hood (3) for the basic housing (2), which covering hood can be moved between a closed position and an open position, so that the basic housing (2) is closed by the covering hood (3) in the closed position. A guide mechanism (4) is provided for mechanically guiding the motion of the covering hood (3) between the closed position and open position. A heater such as a convection heater with a blower heats the air and/or an air humidifier humidifies the air. The covering hood (3) is moved in a simple manner and access to the support for a patient is essentially not hindered by the covering hood (3) in the open position.

2 Claims, 5 Drawing Sheets

THERMOTHERAPHY DEVICE

CROSS REFERENCE TO RELATED APPLICATIONS

This application claims the benefit of priority under 35 U.S.C. §119 of German Patent Application DE 10 2011 009 032.0 filed Jan. 20, 2011, the entire contents of which are incorporated herein by reference.

FIELD OF THE INVENTION

The present invention pertains to a thermotherapy device comprising a basic housing with walls and with a support for a patient and a covering hood for covering the basic housing, which covering hood can be moved between a closed position and an open position, so that the basic housing is closed by the covering hood in the closed position.

BACKGROUND OF THE INVENTION

Thermotherapy devices are used for the care and therapy of premature babies or neonates and infants (patients). A basic housing has a support for the neonate or premature baby. In general, transparent walls are arranged at the basic housing, and the transparent walls can be closed by a movable and transparent covering hood. In a closed position of the covering hood, the basic housing forms an airtight incubator together with the side walls and with the covering hood. Within this airtight housing, the air within the incubator is maintained at a preset temperature by an electric heating means, especially one designed as a convection heater with a blower, and a preset humidity of the air is maintained in the incubator with an air humidifier. Furthermore, a preset oxygen content can also be set in the air within the closed housing of the incubator with an additional oxygen-enriching means.

Thermotherapy devices may also be designed as hybrids. Hybrids are additionally provided with a heat radiation source, e.g., an infrared radiator, and when the covering hood is opened, i.e., when the basic housing is not closed by the covering hood, the patient to be treated is irradiated on the support with infrared rays by means of the heat radiation source and sufficient temperature of the patient or neonate on the support is guaranteed as a result. Even though very good accessibility to the neonate on the support is guaranteed, on the one hand, in an open thermotherapy device used as an open care unit, the preset air humidity cannot be set with the air humidifier, on the other hand, but the humidity of the ambient air is, in general, present. In hybrids used as thermotherapy devices, it is possible to change over between the two modes of operation, i.e., the operation as a closed incubator with the closed covering hood and operation as an open care unit. The covering hood is guided by a guide mechanism for mechanically guiding the motion of the covering hood between the closed and open positions.

U.S. Pat. No. 6,231,499 B1 shows a thermotherapy device. A covering hood is moved here with a linear drive simply upwardly from the bottom and vice versa for moving the covering hood between the closed and open positions. A translatory motion is performed here in each case. The heat radiation source is integrated in the covering hood. The open covering hood undesirably interferes with X-ray and transport. Furthermore, the heat radiation source is switched off for safety reasons in the closed position, so that condensation of water vapor on the covering hood or on the walls of the basic housing may occur.

U.S. Pat. No. 5,971,914 shows a thermotherapy device with a movable covering hood. The covering hood is a two-part hood and can be moved upwardly between the closed position and the open position, on the one hand, by a translatory motion, and each of the two parts can be additionally pivoted by 90° during the motion from the closed position into the open position and vice versa. The covering hood interferes with the access of the care staff to the patient on the support in the open position because the covering hood is located in the head area of the staff in the open position.

A thermotherapy device with a pivotable covering flap is known from WO 2009/073693 A1. The covering flap can be pivoted about an axis of pivot or rotation in the transverse direction of the thermotherapy device and, furthermore, transparent walls of the basic housing can be additionally folded down. However, access to the patient is disadvantageously hindered in the open position of the covering hood, especially in the head area of the patient.

A thermotherapy device with a pivotable covering hood is known from U.S. Pat. No. 4,334,629. In a section at right angles to the axis of pivot or rotation, the covering hood has the shape of a circle segment, i.e., of a part of a circle. Only about half of the area above the support for the neonate is released by the covering hood in the open position of the covering hood, so that the support continues to be inaccessible due to the covering hood or a part of the basic housing at the other half above the support for the neonate. The support for the neonate is thus disadvantageously accessible to a limited extent only in an open position of the covering hood. The freedom of movement of the care staff is thus greatly limited especially for X-raying or for the care of the neonate on the support in an open position of the covering hood.

SUMMARY OF THE INVENTION

An object of the present invention is therefore to make available a thermotherapy device in which the covering hood can be moved in a simple manner between a closed position and an open position and the access to the support for a neonate is not substantially hindered by the covering hood in the open position.

This object is accomplished with a thermotherapy device, comprising a basic housing with walls and with a support for a neonate, a covering hood for the basic housing, which said covering hood can be moved between a closed position and an open position, so that the basic housing is closed by the covering hood in the closed position and the covering hood is removed from the basic housing and/or it does not close the basic housing and/or it does not lie on the basic housing in the open position, and a guide mechanism for mechanically guiding the motion of the covering hood between the closed position and open position. An imaginary vertical projection of the center of gravity of the covering hood lies in its horizontal direction at the rear fifth of the basic housing or behind the basic housing in the open position of the covering hood, always as viewed in the longitudinal direction, i.e., in the direction of the greatest extension of the thermotherapy device, support surface and basic housing. The imaginary vertical projection of the center of gravity of the covering hood is thus located, in an open position of the covering hood, at the rear fifth of the basic housing, especially at a rear fifth of a bottom wall of the basic housing, or especially behind the basic housing. As a result, the covering hood is thus arranged essentially outside the space for accessibility to the neonate by the care staff, and good accessibility to the neonate on the support is guaranteed in the open position of the covering hood.

In particular, the center of gravity of the covering hood is located in its vertical position (a position with respect to a vertical direction) in the open position below the vertical position in the closed position.

In another embodiment, the motion of the covering hood between the closed and open positions and vice versa comprises a rotary motion about at least one axis of rotation. The covering hood thus performs a rotary or pivoting motion about an axis of rotation or pivot axis during the motion between the closed and open positions. As a result, the covering hood can be better removed from the space above the support for the neonate into the open position, so that better accessibility is guaranteed hereby in the open position.

In an additional embodiment, the axis of rotation is directed essentially horizontally and in the transverse direction, e.g., with a deviation of less than 20°, 10° or 5°, and has a distance greater than 10 cm, 20 cm or 30 cm under the closed covering hood and/or is directed below the support for the neonate and/or the angle of rotation of the covering hood is greater than 60°, 70°, 80° or 90° or less than 120°, 100° or 90° between the closed and open positions. During a pivoting or at an angle of rotation of the covering hood between the open position and closed position and vice verse in the range of about 90°, the essentially horizontally directed covering hood may be advantageously directed essentially vertically in the open position, so that the horizontal space requirement for the covering hood is very small as a result in the open position and the covering hood requires as a result little space for installation in the horizontal direction in the area behind the basic housing and, on the other hand, the space above the support is easily and especially readily accessible, because the covering hood is pivoted away from the room above the support.

The motion of the covering hood between the closed and open positions preferably comprises a translatory motion.

In one variant, the projection of the covering hood comprises at least 60%, 80% or 90% of the area of the support for the neonate in a projection of the covering hood in an imaginary vertical projection of the covering hood in the closed position downward onto the basic housing and/or the projection of the covering hood is located especially completely outside the support and/or outside the basic housing in a imaginary vertical projection of the covering hood in the open position downward.

The guide mechanism is advantageously a curved rail, at which the motion of the covering hood between the closed and open positions is mechanically guided with a friction or roller bearing at the covering hood. A rail that comprises flat partial rail sections and the flat partial rail sections approximate a curved line or a curved motion of the covering hood are also considered to be a curved rail. The curved rail may also be designed such that the covering hood performs a rotary motion about one axis of rotation or even about a plurality of axes of rotation during the motion of the covering hood between the closed and open positions and vice versa. The radius of curvature of the motion and of the guide mechanism may also be different over the course of the motion.

In another embodiment, the guide mechanism is a lever mounted pivotably about the axis of rotation, and the covering hood is attached to the lever. The axis of rotation of the lever is thus the axis of rotation of a rotary motion of the covering hood.

The guide mechanism comprises, in particular, a counterlever and a spring. The counterlever is mechanically connected to the lever, and a force can be applied by the spring to the counterlever, so that the torque resulting from the force at the counterlever counteracts the resulting torque at the lever based on the force of gravity of the covering hood. The necessary force for moving the covering hood between the closed position and open position is thus reduced, because the force of gravity acting on the covering hood is partly offset by the force of the spring.

In another embodiment, the basic housing comprises two transparent side walls and a front wall and a rear wall, at least one of which is transparent, and the covering hood lies on these total of four walls in the closed position.

In an additional variant, the thermotherapy device comprises a heat radiation source, especially an infrared radiator, for irradiating the support in the open position of the covering hood. The heat radiation source is used in another variant in the closed position of the covering hood to irradiate the covering hood and preferably the walls of the basic housing in order to prevent condensation on the inside of the covering hood and preferably on the inside of the walls of the basic housing.

In another embodiment, the heat radiation source is arranged on a mounting arm, and the heat radiation source in the vertical direction is arranged above the covering hood in the closed position of the covering hood at the mounting arm. The thermotherapy device is thus a hybrid, which can be used as an incubator in the closed position of the covering hood, in which position a preset temperature and a preset humidity of the air can be controlled and/or regulated by a heater and an air humidifier within the incubator, which is formed by the covering hood and the basic housing with the walls, and, on the other hand, the thermotherapy device is used in an open position of the covering hood as an open care unit, in which sufficient tempering of the patient on the support is guaranteed by the heat radiation source acting on the support and the patient by means of heat radiation.

The thermotherapy device advantageously comprises a frame with at least three, usually four track rollers, and the basic housing with the walls arranged around the support and covering hood with the guide mechanism thereof are attached to the same. The covering hood can be optionally moved by an electric motor. Based on the arrangement of the basic housing with the walls, with the support and with the guide mechanism, the thermotherapy device can be moved, on the one hand, at different positions within a space with the track rollers, and the support can be set variably to a desired working level for the treatment of the patient.

In another embodiment, the basic housing with the support is mounted pivotably about a horizontal pivot axis at the frame for positioning the patient with the head in a high or low position. Only the basic housing is mounted pivotably about the horizontal pivot axis at the frame, so that such a pivoting mechanism has a very simple and inexpensive design and the covering hood can thus be opened or raised and closed or lowered in any position of the basic housing.

Exemplary embodiments of the present invention will be described in more detail below with reference to the drawings attached. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
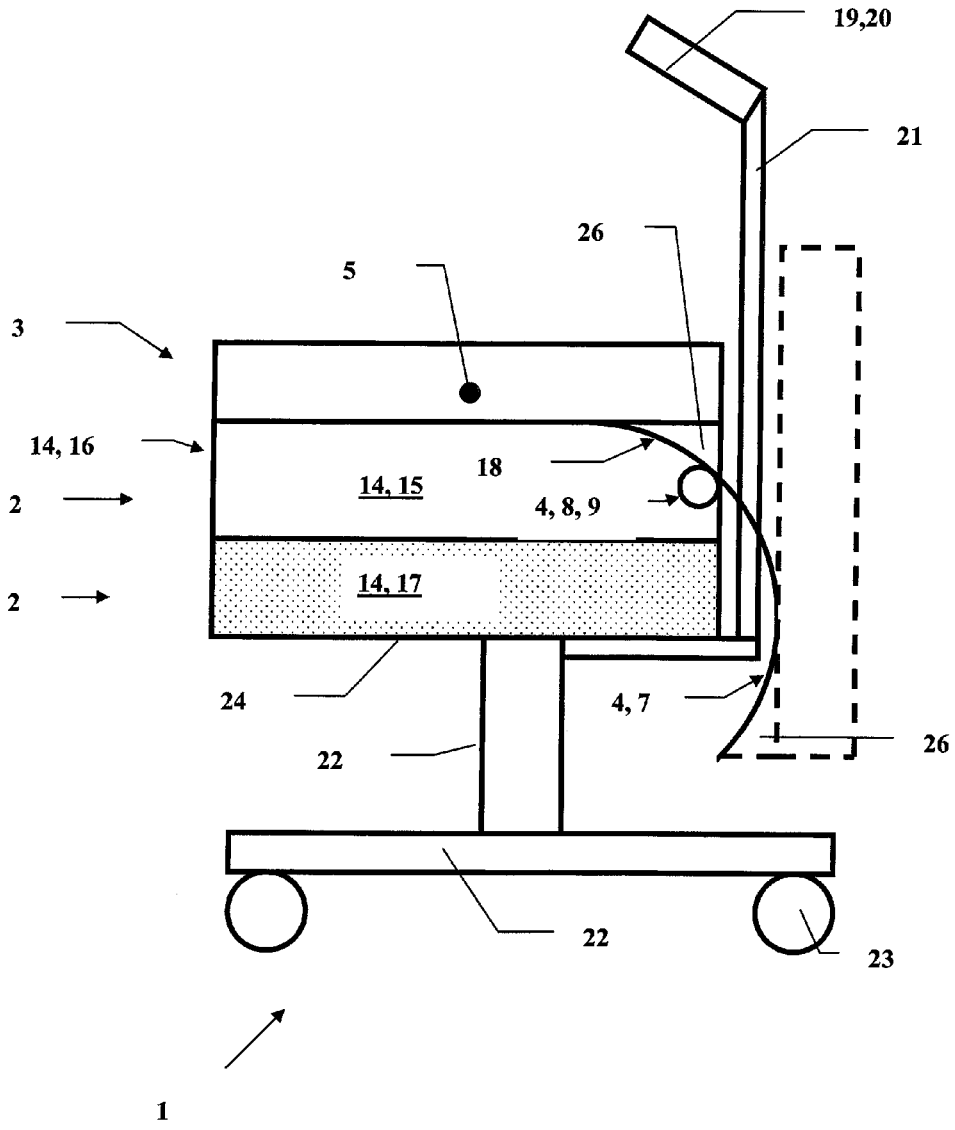
FIG. 1 is a schematic side view of a thermotherapy device in a first exemplary embodiment with a covering hood in a closed position.
Figure 2:
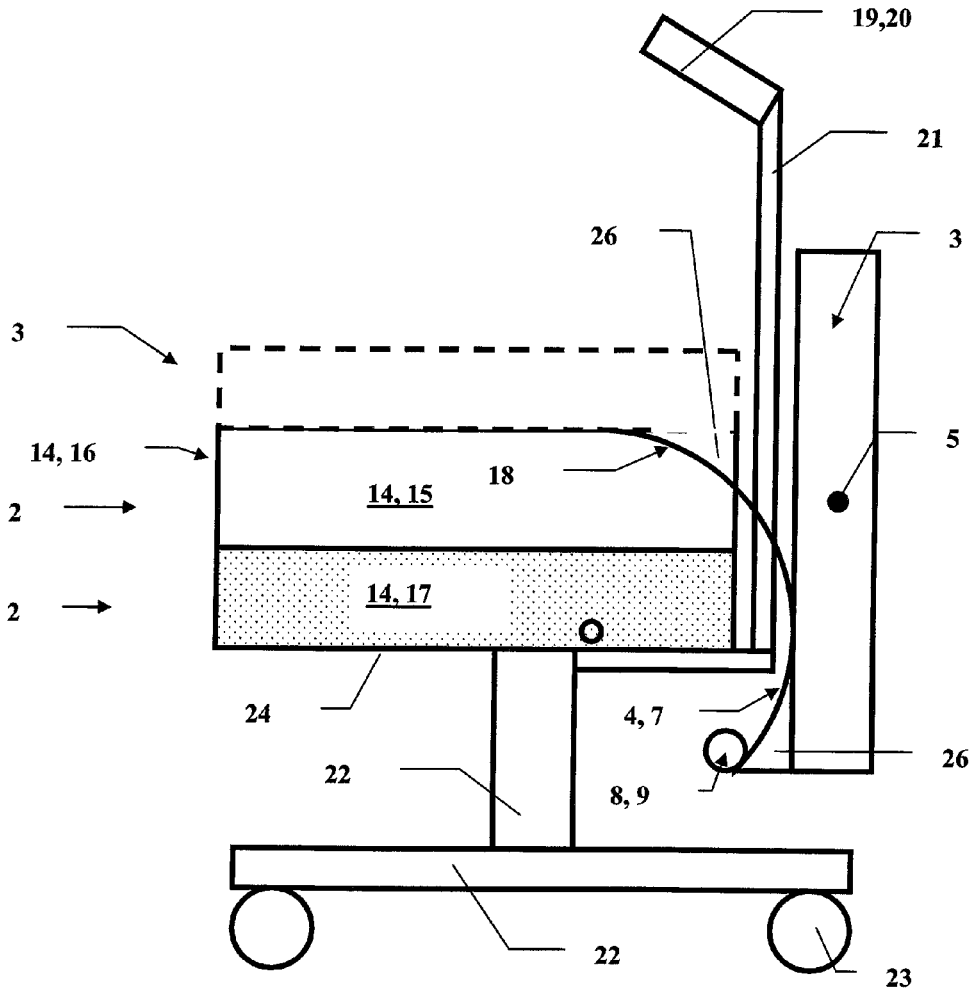
FIG. 2 is a schematic side view of the thermotherapy device according to FIG. 1 with the covering hood in an open position.

Referring to the drawings in particular, thermotherapy devices 1 are used in hospitals for the care and therapy of premature babies and infants. FIGS. 1 and 2 show a first exemplary embodiment of the thermotherapy device 1 with a view from the side towards the device directed in the direction of the greater longitudinal extension. A basic housing 2 has a nontransparent bottom wall 24, two transparent side walls (with upper side wall or wall portion and lower side wall or side wall portion) 15, 17 as walls 14 of the basic housing as well as a transparent front wall 16 and a transparent or nontransparent rear wall. The front, rear and side walls are attached to the nontransparent bottom wall 24 in the end section of the nontransparent bottom wall 24, and a support, not shown, for a patient to be treated, e.g., a premature baby, is present above the bottom wall 24. A plane defined by the transparent side walls 15, 17, transparent front wall 16 and nontransparent rear wall is essentially at right angles to a plane defined by the nontransparent bottom wall 24. Only one of the two transparent side walls 15 (17) and the transparent front wall 16 are visible in FIGS. 1 and 2. The two transparent side walls 15 have, at their upper rear end sections, a rounding 18, which is designed essentially as a circle segment, i.e., part of a circle.

The basic housing 2 is attached to a frame 22, and four track rollers 23 are present in the lower area of frame 22, so that, on the one hand, the thermotherapy device 11 can be rolled on the track rollers 23 to different positions within a room and, on the other hand, the basic housing 2 or support for the patient to be treated already has the correct working height. Furthermore, the height of the basic housing 2 at the frame 22 can be adjusted relative to the floor with a lever mechanism, not shown. The distance of the support from the floor is thus variable, so that different working heights of the support can also be set for different members of the care staff. Furthermore, a mounting arm 21 is arranged at frame 22, and a heat radiation source 19 designed as an infrared radiator 20 is present in the upper end area of the mounting arm 21 above the support for the patient. Infrared radiation can be radiated by the heat radiation source 19 from the top downward in the direction of the support. Furthermore, a convection heater designed preferably as an electric heater is present at the basic housing 2 along with a blower and an air humidifier for humidifying the air (not shown) when the covering hood 3 is closed. The temperature of the air at the support can be maintained at a constant value with the heater. A desired temperature of the air in the area of the support can be selected by means of a setting means, not shown. Furthermore, the humidity of the air at the support can be maintained at a constant value with the air humidifier. The humidity that is desired can likewise be selected with a setting means. In addition, the thermotherapy device 1 is optionally equipped with an oxygen supply device, so that a constant oxygen content can be set in the area at the support with the oxygen supply device. A certain oxygen content can be selected with a setting means at the support by the care staff analogously to the selection of the temperature and the humidity of the air at the support.

The thermotherapy device 1 is designed as a hybrid. The basic housing with the walls 14 can be sealed with the movable covering hood 3 essentially hermetically against the ambient air in a closed position according to the view in FIG. 1, so that the basic housing 2 and covering hood 3 form an incubator. The parameters temperature, air humidity and oxygen content of the air within the incubator can be maintained at constant values at respective preset levels in this closed position by the heater and air humidifier and oxygen supply device within the incubator, i.e., with the covering hood 3 closed. The covering hood 3 can be moved from the closed position according to the view in FIG. 1 into an open position according to the view in FIG. 2 with a guide mechanism 4. The open position of the covering hood 3 is indicated by a broken line in FIG. 1 and the closed position of the covering hood 3 is indicated by a broken line in FIG. 2. A sufficient temperature of the patient to be treated on the support is guaranteed in the open position of the covering hood 3 according to FIG. 2 by the heat radiation source 19, which sends infrared radiation towards the patient on the support. Furthermore, the two transparent side walls 15 and the transparent front wall 16 can be folded down about an axis of pivot or rotation for better accessibility to the patient in the open position of the covering hood 3. The axis of pivot or rotation is located essentially between a lower end of the transparent side wall 15 and an upper end of the transparent side wall 17 and analogously between the lower end or at the lower end of the transparent front wall 16 and at the upper end of the nontransparent front wall of the basic housing 2, not shown, for the transparent front wall 16.

The guide mechanism 4 comprises here a curved rail 7. The covering hood 3 is movably attached to the curved rail 7 with a bearing roller 9 as a roller bearing 8, so that a preset path of motion of the covering hood 3 is performed during a motion of the covering hood 3 between the closed position according to FIG. 1 and the open position according to FIG. 3 and vice versa. The covering hood 3 performs both a translatory motion and a rotary motion during the motion between the closed position and open position. In the open position of the covering hood 3 according to FIG. 2, a center of gravity 5 of the covering hood 3 is located behind the basic housing 2 or behind the bottom wall 24 of the basic housing 2. Furthermore, the covering hood 3 is pivoted by 90° between the closed position in FIG. 1 and the open position in FIG. 2, so that the entire space above the support for the patient is very readily accessible in the open position of the covering hood 3. Furthermore, the covering hood 3 requires only a very small horizontal space in the open position according to FIG. 2, so that the space between the basic housing 2 or the nontransparent bottom wall 24 and the frame 22 for receiving the covering hood 3 easily suffices. The transparent covering hood 3 is optionally provided with a grip, not shown, or a grip means, with which the covering hood 3 can be easily moved from the open position into the closed position and vice versa. The two transparent side walls 15 have the rounding 18, and the covering hood 3 has two rounded projections 26. The two projections 26 as well as the rounding 18 are necessary for the covering hood 3 to be able to follow the path of motion preset by rail 7. The height of the rear wall of the basic housing 2 corresponds here to the height of the rear end of the transparent side wall 15 at the rear end of the rounding 18 from the bottom wall 24.

Thus, the thermotherapy device 1 is an open care unit in the open position of the covering hood 3, and the thermotherapy device 1 is an incubator in the closed position of the covering hood 3. Infrared radiation can thus be radiated with the heat radiation source 19 at a reduced radiation output in the direction of the covering hood 3 in the closed position of the covering hood 3 as well, so that the walls 14 of the incubator, especially the transparent walls 14 of the basic housing 2, and the transparent covering hood 3 are heated as a result, and no condensation or moisture appears on the inside of the incubator.

Figure 3:
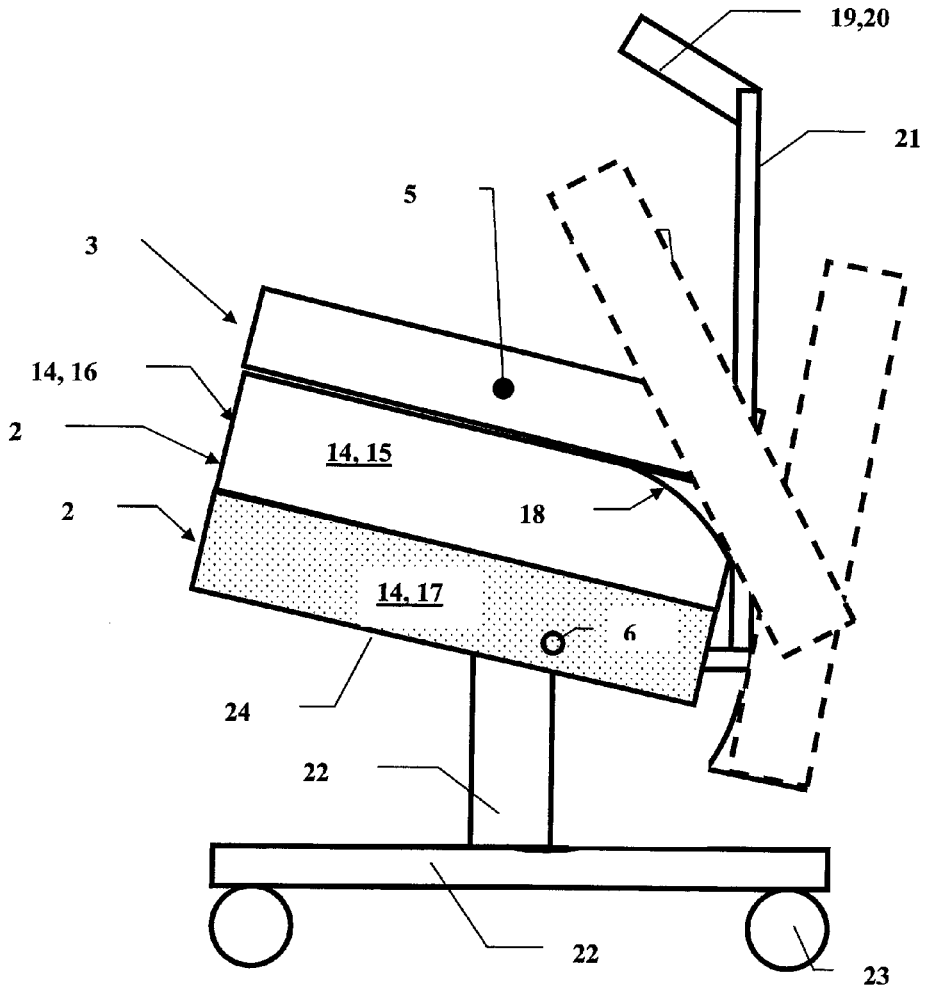
FIG. 3 is a schematic side view of the thermotherapy device in a second exemplary embodiment with the covering hood in a closed position.
Figure 4:
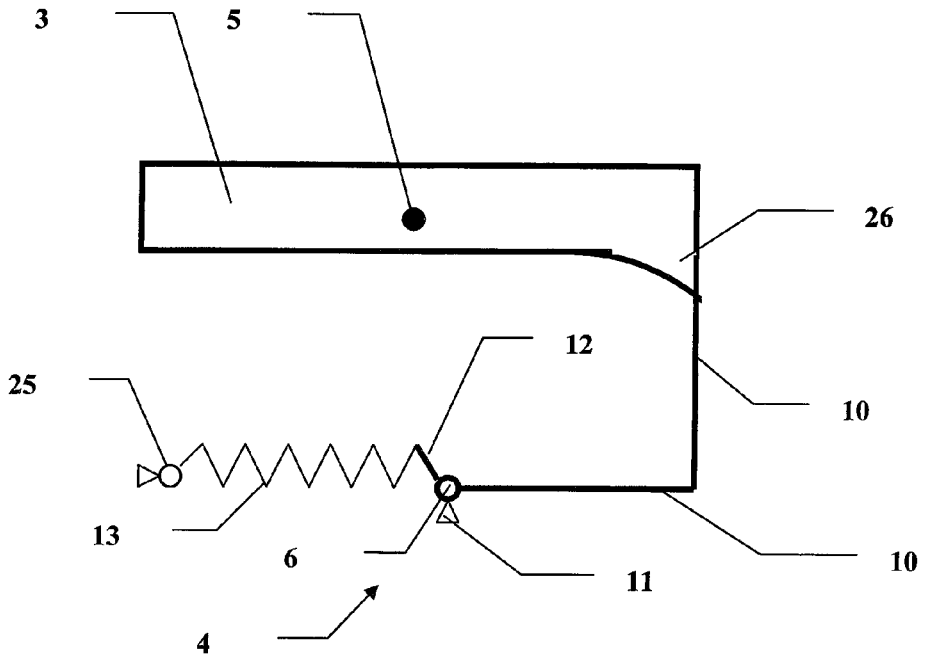
FIG. 4 is a simplified view of a guide mechanism for the covering hood of the thermotherapy device according to FIG. 3 in a closed position of the covering hood.
Figure 5:
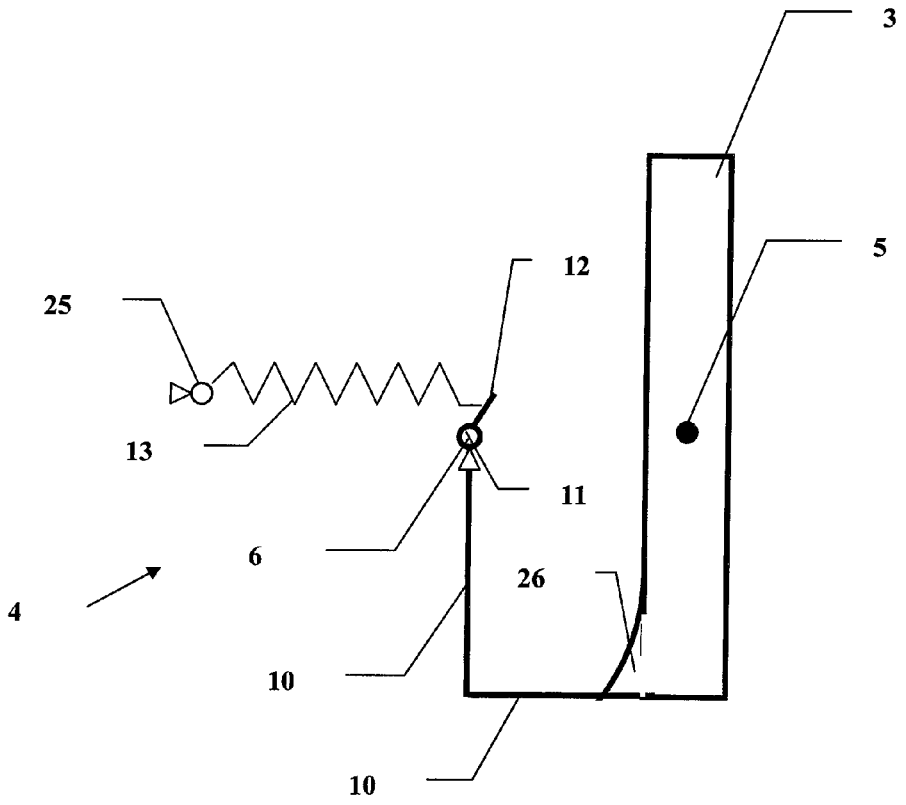
FIG. 5 is a simplified view of the guide mechanism according to FIG. 4 in an open position of the covering hood.

FIGS. 3, 4 and 5 show a second exemplary embodiment of the thermotherapy device 1. Essentially only the differences from the first exemplary embodiment according to FIGS. 1 and 2 will be described below. The guide mechanism 4 (shown in FIGS. 4 and 5 only) comprises a lever 10, which is mounted pivotably at a lever mount 11 about an axis of rotation 6. Furthermore, a counterlever 12 is attached to lever 10, and a spring 13 is arranged in the end area of counterlever 12. The spring 13 is attached, furthermore, to a spring mount 25, so that a pulling force and hence also a torque are applied by the spring 13 to the counterlever 12 in a direction of rotation opposite the clockwise direction according to FIGS. 4 and 5. Covering hood 3 is attached to lever 10.

A closed position of the covering hood 3 is indicated by solid lines in FIG. 3. The open position of the covering hood 3 as well as an intermediate position of the covering hood 3 are shown by broken lines. In the simplified view of the guide mechanism 4, FIG. 4 shows a closed position of the covering hood 3 and FIG. 5 shows an open position of covering hood 3. Due to the covering hood 3 being attached to the lever 10, the covering hood 3 performs a rotary motion about the axis of rotation 6 during a motion between the closed position and open position. The torque acting on the counterlever 12 from the spring 13 counteracts the force of gravity of the covering hood 3, so that the covering hood 3 can be moved more easily as a result during a motion from the closed position into the open position.

Furthermore, the basic housing 2 is mounted at the frame 22 pivotably about a horizontal pivot axis, especially relative to a pivot axis in the transverse (lateral) direction to the greater longitudinal extension of the thermotherapy device 1. FIG. 3 shows such a slight pivoting of the basic housing 2 in relation to a horizontal direction (a horizontal use position) shown in FIGS. 1 and 2. Such a pivoting mechanism for pivoting the basic housing 2 may have an especially simple design because only the basic housing 2 is to be pivoted and sufficient space is available for this pivoting motion. A non-pivotable basic housing 2 would have the drawback that the oblique positioning of the support for the patient within the basic housing 2 has to be performed by means of the support and the support must therefore be made higher than the bottom wall 24. The thermotherapy device 1 also comprises, furthermore, access openings for the hands, especially on side and/or front walls.

On the whole, essential advantages are associated with the thermotherapy device 1 according to the present invention as a hybrid. The covering hood 2 can be pivoted between the closed position, when the thermotherapy device 1 is used as an incubator, and an open position of the covering hood 3, when the thermotherapy device 1 is used as an open care unit, in a simple manner with little technical effort, and very good accessibility to the patient is guaranteed for the care staff in the open position of the covering hood 3. In the open position, the covering hood 3 is now completely behind the basic housing 2 as viewed in the longitudinal direction of the thermotherapy device 1.

While specific embodiments of the invention have been shown and described in detail to illustrate the application of the principles of the invention, it will be understood that the invention may be embodied otherwise without departing from such principles.

What is claimed is:

1. A thermotherapy device comprising:

a basic housing with walls and with a support for a patient, the walls extending away from the support to define a region adapted to surround a patient on the support, the region being open on a side diametrically opposite the support;

a covering hood for the basic housing, the covering hood being movable between a closed position and an open position, so that the basic housing is closed by the covering hood in the closed position; and a guide mechanism for mechanically guiding the motion of the covering hood between the closed position, in which the covering hood extends essentially horizontally, and the open position, in which the covering hood extends essentially vertically, wherein an imaginary vertical projection of a center of gravity of the covering hood lies, in the open position of the covering hood, with respect to a horizontal direction, at a rear fifth of the basic housing or behind the basic housing, wherein the basic housing comprises two transparent side walls and a transparent front wall, the covering hood lies on the basic housing in the closed position of the covering hood, the motion of the covering hood between the closed and open positions and vice versa comprising a rotary motion about an axis of rotation, the guide mechanism comprising a lever mounted pivotably about the axis of rotation and the covering hood is attached to the lever, the guide mechanism further comprising a counterlever and a spring, the counterlever being mechanically connected to the lever, a force being applied by the counterlever by the spring so that the torque resulting from the force at the counterlever counteracts the resulting torque at the lever based on the force of gravity acting on the covering hood.

2. A thermotherapy device comprising:

a basic housing with walls and with a support for a patient;

a covering hood for the basic housing, the covering hood being movable between a closed position and an open position, so that the basic housing is closed by the covering hood in the closed position; and a guide mechanism for mechanically guiding the motion of the covering hood between the closed position, in which the covering hood extends essentially horizontally, and the open position, in which the covering hood extends essentially vertically, wherein an imaginary vertical projection of a center of gravity of the covering hood lies, in the open position of the covering hood, with respect to a horizontal direction, at a rear fifth of the basic housing or behind the basic housing, wherein the basic housing comprises two transparent side walls and a transparent front wall, the covering hood lies on the basic housing in the closed position of the covering hood, the guide mechanism comprises a lever mounted pivotably about the axis of rotation and the covering hood is attached to the lever, the guide mechanism further comprises a counterlever and a spring, the counterlever is mechanically connected to the lever, and a force is applied by the counterlever by the spring so that the torque resulting from the force at the counterlever counteracts the resulting torque at the lever based on the force of gravity acting on the covering hood.

* * * * *